US008362406B2

(12) United States Patent
Bohlender et al.

(10) Patent No.: US 8,362,406 B2
(45) Date of Patent: Jan. 29, 2013

(54) METHOD OF MANUFACTURING AN ELECTRIC HEATING DEVICE AND ELECTRIC HEATING DEVICES

(75) Inventors: Franz Bohlender, Kandel (DE); Michael Niederer, Kapellen Drusweiler (DE); Michael Zeyen, Herxheim-Hayna (DE); Rainer Wuenstel, Neustradt (DE); Detlef Stephan, Landau-Morzheim (DE)

(73) Assignee: Catem GmbH & Co. KG, Herxheim bei Landau (DE)

( * ) Notice: Subject to any disclaimer, the term of this patent is extended or adjusted under 35 U.S.C. 154(b) by 1230 days.

(21) Appl. No.: 12/175,173

(22) Filed: Jul. 17, 2008

(65) Prior Publication Data

US 2009/0026194 A1 Jan. 29, 2009

(30) Foreign Application Priority Data

Jul. 18, 2007 (EP) ..... 07014118

(51) Int. Cl.

| | |
|---|---|
| ***H05B 3/06*** | (2006.01) |
| ***H05B 3/10*** | (2006.01) |
| ***F24H 3/10*** | (2006.01) |
| ***F24D 13/00*** | (2006.01) |
| ***B60H 1/22*** | (2006.01) |

(52) U.S. Cl. ..... 219/548; 219/202; 392/347; 392/360

(58) Field of Classification Search ..... 219/532, 219/504, 530, 553, 201, 202, 537, 548, 481, 219/510, 505; 337/405

See application file for complete search history.

(56) References Cited

U.S. PATENT DOCUMENTS

| | | | | |
|---|---|---|---|---|
| 4,327,282 | A * | 4/1982 | Nauerth | 219/541 |
| 4,948,953 | A * | 8/1990 | Starck | 219/504 |
| 4,990,748 | A * | 2/1991 | Starck | 392/485 |
| 5,377,298 | A * | 12/1994 | Yang | 392/360 |
| 5,665,261 | A * | 9/1997 | Damsohn et al. | 219/504 |
| 6,373,705 | B1 * | 4/2002 | Koelle et al. | 361/720 |
| 7,087,868 | B2 * | 8/2006 | Hamburger et al. | 219/541 |
| 7,297,901 | B2 * | 11/2007 | Lee | 219/202 |
| 7,361,868 | B2 * | 4/2008 | Otto et al. | 219/528 |
| 7,676,144 | B2 * | 3/2010 | Zeyen et al. | 392/502 |
| 7,777,161 | B2 * | 8/2010 | Zeyen et al. | 219/520 |
| 7,977,610 | B2 * | 7/2011 | Hamburger et al. | 219/537 |
| 8,084,721 | B2 * | 12/2011 | Mori et al. | 219/534 |
| 2005/0072774 | A1 * | 4/2005 | Bohlender | 219/548 |
| 2005/0175328 | A1 | 8/2005 | Pierron et al. | |

(Continued)

FOREIGN PATENT DOCUMENTS

| | | |
|---|---|---|
| EP | 0 705 055 A2 | 4/1996 |
| EP | 1 061 776 A1 | 12/2000 |

(Continued)

*Primary Examiner* — Joseph M Pelham

(74) *Attorney, Agent, or Firm* — Boyle Fredrickson, S.C.

(57) ABSTRACT

An electric heater, comprises a heating block held in a housing and including parallel layers of heat-emitting and heat generating elements. A grid arrangement covers the respective frame apertures in the housing and reinforces the housing. First struts of the grid arrangement, extending at right angles with respect to the layers, are assigned to the housing, and second struts extending parallel with respect to the layers are defined by the heating block. Moreover, a heat generating element of an electric heater, comprises a position frame made of an insulating material and defining receptacles arranged side by side each for at least one PTC heating element. The receptacles are arranged between conductor paths against which the PTC heating elements are placed in an electrically conductive manner.

8 Claims, 7 Drawing Sheets

U.S. PATENT DOCUMENTS

| | | | | |
|---|---|---|---|---|
| 2005/0230377 | A1 | 10/2005 | Bohlender et al. | |
| 2006/0273078 | A1 * | 12/2006 | Hong | 219/202 |
| 2007/0068927 | A1 | 3/2007 | Bohlender et al. | |

FOREIGN PATENT DOCUMENTS

| | | | |
|---|---|---|---|
| EP | 1 432 287 | A1 | 6/2004 |
| EP | 1528838 | A2 * | 5/2005 |
| EP | 1 768 459 | A1 | 3/2007 |
| GB | 2 033 709 | A | 5/1980 |
| GB | 1 583 771 | A | 2/1981 |
| JP | 7201454 | A | 8/1995 |
| WO | 03 086018 | A1 | 10/2003 |

* cited by examiner

METHOD OF MANUFACTURING AN ELECTRIC HEATING DEVICE AND ELECTRIC HEATING DEVICES

BACKGROUND OF THE INVENTION

1. Field of the Invention

The present invention relates to an electric heater, comprising a heating block which is held in a housing defining opposite frame apertures and includes parallel layers of heat-emitting and heat generating elements, and comprising a grid arrangement covering the respective frame aperture and reinforcing the housing.

2. Description of the Related Art

An auxiliary heater of this nature for conditioning the air in the interior of a motor vehicle is for example known from EP 1 564 503. The heat generating elements of the heating block normally comprise several PTC heating elements which are provided overlapping in one plane and are arranged between printed conductors which are normally formed by sheet metal bands. These printed conductors carry current with different polarities. The PTC elements can be glued to these printed conductors. It is also possible for the printed conductors to contact the PTC heating elements under tension. In any case it must be ensured that for extracting the heat produced by the PTC heating elements and for feeding current, good contact between the printed conductors and the PTC heating elements exists.

One or more heat generating elements can be provided as part of the heating block. The heat produced by the heat generating elements is dissipated through heat dissipating elements to the medium to be heated, i.e. the air. It flows through the housing through the two frame openings which accommodate the flat heating block. The frame openings here lie normally parallel to one another on oppositely situated sides of an essentially flat, frame-shaped housing. With regard to the most economical manufacture of the electrical heating device, the heat dissipating elements are generally formed from meander-type bent sheet strips, which form corrugated ribs. These corrugated ribs contact heat dissipating elements on one or both sides. Consequently, the heating block comprises several layers of heat dissipating and heat generating elements, wherein it must also be ensured with regard to the thermal emission that the heat dissipating elements have a good contact to the heat generating elements. Also in this respect, the heat dissipating elements can be permanently joined to the heat generating elements and/or contact them under tension through at least one spring element accommodated in the housing.

Instead of a meander-type sheet metal band, the heat dissipating element can also be formed by an extruded aluminium profile, which forms ridges, which extend essentially at right angles to the layers of the layer structure comprising the heat dissipating and the heat generating elements. In a case of this nature the printed conductor, i.e. the generally flat locating face, for the PTC heating element can be formed by the outer surface of an extruded aluminium profile of this nature. With both alternatives, corrugated rib element or extruded profile, the locating face for the PTC heating elements is formed electrically conducting and is electrically connected to contacts which are normally mounted insulated from one another. In the first case the contacts are generally formed by the exposed ends of the sheet metal bands.

The layered heating block consisting of parallel heat dissipating and heat generating elements, optionally with one or more additional spring elements extending parallel to it, is preferably mounted in a housing with a U-shaped cross-section. When the layer structure is subjected to the pressure of a spring, the frame has to be dimensioned such that the spring force can be continuously maintained even at increased temperatures. Here it should be noted that the insulating frame is nowadays manufactured as an injection moulded part, due partially to economical reasons. Normal housings nowadays consist of a housing lower part and a housing upper part. The housing lower part here forms a receptacle for the individual elements of the heating block and, where required, of the spring element. The individual elements of the heating block are arranged in this housing lower part. Then the heating block is enclosed in the housing by joining the housing upper part and the housing lower part. To achieve this, edges which surround the frame openings can partially cover the heating block so that the heating block is enclosed between the frame openings and mounted in the housing. The two housing parts are then joined together, for example using a latching connection.

With this type of assembly there is the problem that the individual layers of the heating block must be arranged at a predetermined point in the housing. Since not every heat generating element is assigned its own contacts, the electrical conditions within the heating block must also be considered during assembly. However to minimise the manufacturing costs, there is also the desire to form the parts of the heating block as standardised as possible, so that identical components can be used for different layers of the heating block.

Furthermore, the housing itself should be able to be manufactured as simply as possible with regard to an economical manufacture of the electrical heating device. Here however, the particular requirements for the practical installation of one or more spring elements in the housing have to be followed when on joining the housing parts the heating block is already subjected to prestressing in the frame so that joining has to take place against this prestressing.

With regard to the previously discussed problems, in EP 1 564 503 an electrical heating device of the generic type has already been suggested in which the layers of the heating block including a spring element are first mounted in a housing lower part initially free of tension. A housing upper part, which can be connected to it, forms an oblique sliding surface which extends over the end of the spring element protruding up from the housing lower part in relation to the outer side of the heating block. When joining the housing upper part and housing lower part, the spring element is accordingly compressed in the direction of the heating block and contacts it prestressed.

This prior suggestion leads to a certain simplification during assembly, which however requires that the elements of the heating block, as also the spring element, are brought into the correct positions in the housing lower part. Furthermore, the housing implemented with this electrical heating device has various oblique surfaces, which are required for stressing and enclosing the spring element when joining the housing parts.

The present invention is based on the problem to provide an electric heater, which allows a more simple and, thus, more inexpensive production. Furthermore, the present invention wishes to provide a heat generating element of an electric heater, which is suited for its installation into the aforementioned electric heater. According to another independent aspect of the present invention a housing is provided, which can be employed as a part of the electric heater according to the present invention and which is particularly suited to receive the heat generating elements proposed in accordance with the present invention.

To overcome the first-mentioned problem, the present invention proposes an electric heater comprising a planar heating block which is held in a housing defining opposite frame openings and which includes parallel layers of heat-emitting and heat-generating elements. The electric heater additionally includes a grid arrangement covering the respective frame openings and reinforcing the housing wherein the first struts of the grid arrangement extending at right angles with respect to the layers are assigned to the housing and second struts, extending parallel with respect to the layers, are defined by the heating block. This heater differs from the generic electric heater in that first struts of the grid arrangement extending at right angles with respect to the layers are assigned to the housing and in that second struts extending parallel with respect to the layers are defined by the heating block.

Contrary to EP 1 432 287 B1 the grid arrangement of the present invention is not only defined by the two housing parts connected to each other, but the housing parts merely include those struts which extend as first struts at right angles to the layers of the heating block. The grid elements extending at right angles with respect to the above and designated as second struts are defined by the heating block. The second struts thereby serve as a certain shield for the heat generating element, which comprises, as a rule, two parallel conductor paths having different polarities and PTC elements provided there between and arranged side by side. Preferably, the second strut externally overlaps the two conductor paths in the region of the frame aperture, thereby preventing that foreign particles penetrating from outside with the air to be heated through the frame opening cause a short circuit between the opposite conductor paths on the longitudinal side of the heat generating element subjected to the flow.

The first and second struts of the inventive electric heater each advantageously contribute to a certain reinforcement of the grid arrangement honeycombing the frame opening. To this end it is not necessary, however, that the struts crossing each other and provided at right angles with respect to each other be firmly connected to each other. A certain form-closure and/or a certain support of the first and second struts is rather sufficient to achieve a certain reinforcement of the grid arrangement.

The second struts are defined by the heating block, so that the position of the corresponding second struts in the housing is predefined only by the installation situation of the layers of the heating block. Thus, it is possible more easily to provide the second struts in the region of the heat generating elements, for example, in order to cover the conductor paths having different polarities on the front face. Contrary to the above-explained prior art there no longer exists the problem of a narrow tolerance adaptation of the geometric configuration of the housing, on the one hand, to the layers of the heating block, on the other hand, which are mounted herein to be sometimes movable, at least, however, with a certain play.

In this respect it is proposed in a preferred embodiment of the present invention to provide the second struts in sections between the first struts, namely in such a way that the first struts are each fixed between two sections of the first struts in a form-closed manner, which means that the first struts are only slightly movable or not movable at substantially right angles to their extension, i.e. parallel to the longitudinal extension of the second struts, and are accordingly held between the respective sections in a form-closed manner.

In the aforementioned further development the second struts can engage into recesses of the first struts, which are adapted to the dimension of the second struts, so as to produce an engagement connection fixing the two struts with respect to each other in a substantially immovable manner. With respect to the reinforcement and particularly by taking into account possible manufacturing tolerances it has proved to be advantageous, however, to arrange the second struts in the longitudinal direction of the first struts to be movable with respect to the same. This particularly means that the two struts are mounted to be slightly movable relative to each other, which allows the compensation of manufacturing tolerances and, respectively, a certain yielding of the individual layers of the heating block, for example, for compensating thermal expansions and/or as a reaction to a tensile force acting onto the heating block from outside, which is exerted by one or more springs installed in the housing.

The second struts may be formed as shielding components between the heat-emitting or heat generating elements or as part thereof. Particularly reliable is an embodiment in which the second struts are directly defined by parts of the heat generating element. It has proved to be advantageous to define the second struts by position frames made of an insulating material, which define receptacles provided side by side each for at least one PTC heating element and which are arranged between conductor paths against which the PTC heating elements are placed in an electrically conductive manner. According to this preferred embodiment the struts are formed as an element integrated in the heat generating elements, so that a correct positioning of the struts can be guaranteed in an easy manner.

To achieve a good shielding of the electric conductor paths, and in view of a desired mechanical interaction and support of the two struts, it is proposed according to a preferred further development of the present invention to place the conductor paths onto both sides of the PTC elements, i.e. to provide the conductor paths as elements which are initially separate and dissociated from the PTC elements, and to define the sections of the second struts such that they externally overlap the conductor paths, thereby captivating them to the position frame. With this preferred embodiment a preassembled unit is provided, which can be handled and installed as an integrated element during the production of the electric heater.

The constructive requirements demanded from the sections and struts, respectively, with respect to fixing the conductor paths may thereby be relatively small, if the conductor paths abut, in the assembled condition, on the PTC heating elements by means of a spring device holding the heating block in the housing under a spring pretension, which is known, for example, from EP 1 432 287 and EP 1 564 503.

In order to manufacture the second struts by taking into account a careful treatment of the material, it is proposed according to another preferred embodiment of the present invention to define the upper and lower side of the heat generating elements between the sections of the second struts by the conductor paths. The conductor paths are accordingly exposed between the sections of the second struts and are shielded and, thus, covered by the struts only after the installation into the housing. The further development moreover permits a relatively flat structure of the electric heater if relatively many standardized components are used, e.g. sheet metal bands as conductor paths.

OBJECT OF THE INVENTION

To solve the independent aspect of the present invention, the same provides for a heat-emitting element of an electric heater of the aforementioned type, which comprises a position frame made of an insulating material, which defines receptacles arranged side by side each for a PTC element, which are arranged between conductor paths against which the PTC heating elements are placed in an electrically conductive manner. This heat generating element known from EP 1 564 503 is developed further by the present invention in that the position frame comprises retaining ridges surrounding and limiting the conductor paths, which externally overlap the conductor paths and abut on the same. Accordingly, the holding webs fix the loosely mounted conductor paths, which are preferably realized in the form of sheet metal bands, with respect to the position frame, by which a preassembled unit is created the parts of which are connected to each other in a captive manner. Accordingly, the heat generating element is easy to handle and can easily be inserted into the housing. Moreover, the holding webs are placed against the conductor paths, so that the elements of the heat-emitting element are connected to each other in a closely spaced manner and also the PTC heating elements are fixed in the receptacles by being placed against the inner sides of the conductor paths so that, for example, several PTC heating elements can be arranged and fixed in a receptacle at predetermined positions.

Preferred further developments of the inventive heat generating element include providing retaining ridges that abut on the conductor paths merely on an edge side thereof. Further the heat generating element may have retaining ridges that are formed in a plurality of sections with a passage between adjacent sections. Moreover the heat generating element may be configured so that the passage extends to the conductor path formed by a continuous sheet metal band. In addition, the heat generating element may be constructed so that the retaining ridges are formed integrally with the positional frame by injection molding and, after placing the conductor paths onto the positional frame, are plastically deformed to overlap the conductor paths. Finally, the heat generating element may be configured so that the retaining ridges are bent over the conductor paths by thermoforming.

The present invention further provides for a housing of a heater, in which the heat generating element according to the present invention can be installed to produce the electric heater according to the present invention. This housing is characterized in that the frame openings are interspersed with struts which extend merely at right angles with respect to the layers of heat dissipating and heat generating elements. Prior to the assembly of the housing this special feature of the struts results from a comparison between the structural design of the accommodating openings for parts of the heating block, which may be provided at the frontal ends of the layers of the heating block, or of the slots or other lead throughs for electric conductor paths of the heating block, which are usually also lead out of the heating block at the front face, where they are lead into the housing in alignment with the struts of the housing.

Further details and advantages of the present invention are given in the following description of an embodiment in conjunction with the drawing. This shows the following:

DETAILED DESCRIPTION OF THE PREFERRED EMBODIMENT

Figure 1:
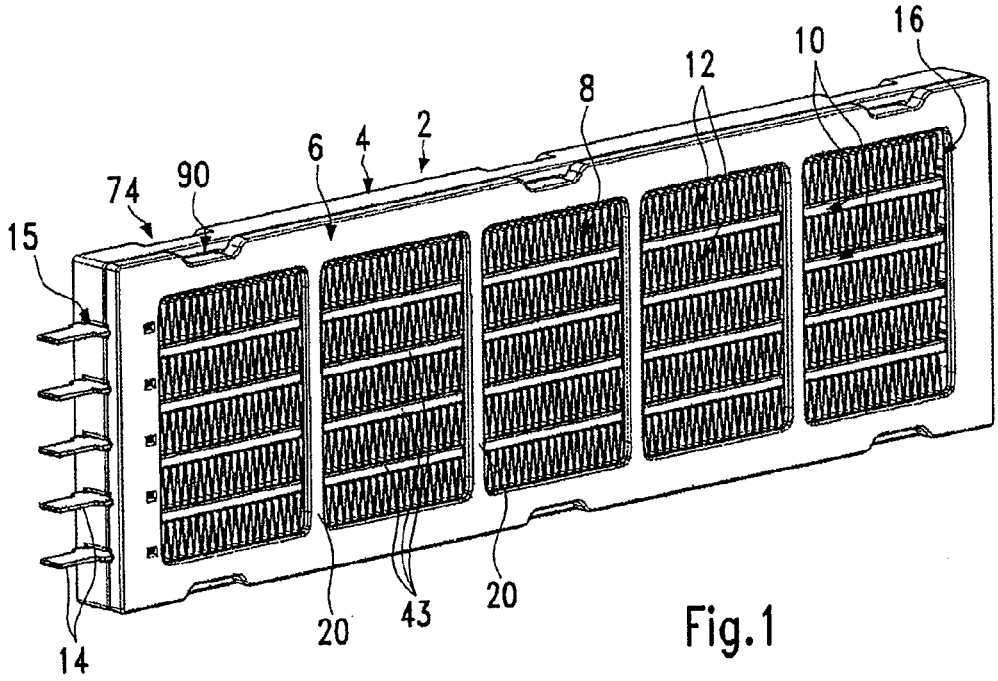
FIG. 1 a perspective side view of an embodiment of the electrical heating device.

FIG. 1 shows a perspective side view of an embodiment of the electrical heating device with a housing 2, consisting of a housing lower part 4 and a housing upper part 6. Both housing parts 4, 6 are joined together positively locked and accommodate a heating block 8, which consists of several heat generating elements 10 and heat dissipating elements 12 arranged in layers parallel to one another. The heat dissipating elements 12 are formed as corrugated rib elements from meander-type bent sheet metal strips.

Five contact lugs 14, arranged one over the other in the transverse direction protrude over a face side of the housing 2. The contact lugs pass through the housing 2 at the cut-out slots 15, each of which accommodate one contact lug and are mainly formed by the housing lower part 4, but are complemented on a face side by the housing upper part 6.

The housing 2 has two oppositely situated frame openings, of which in FIG. 1 only the frame opening 16 formed by the housing upper part 6 can be seen. The frame opening formed by the housing lower part 4 can be seen in FIG. 4 and is identified with the reference numeral 18. The frame openings 16, 18 are each interspersed with struts 20, which extend at right angles to the layers of the heating block 8 and which join together longitudinal spars oppositely situated to one another on the housing lower part 4 and housing upper part 6.

Figure 2:
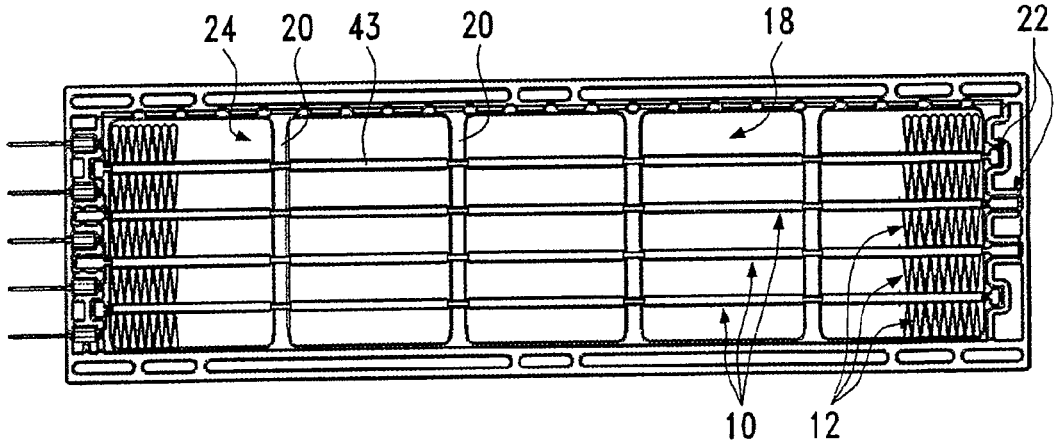
FIG. 2 a side view of a housing lower part with an installed heating block from the embodiment illustrated in FIG. 1.

FIG. 2 illustrates details of the heating block 8 and its accommodation in particular in the housing lower part 4 and illustrates the housing lower part 4 in a plan view with the housing upper part removed. The heat dissipating elements 12 are only illustrated incomplete on the respective face side ends of the housing lower part 4. Accordingly, the illustration in FIG. 2 provides a view onto the frame opening 18 formed by the housing lower part 4.

As can be seen, the illustrated embodiment has four heat generating elements 10, which are each insulating on the face side and are accommodated with a certain movement transverse to the layers of the layer structure (heating block 8) in the housing lower part 4. The housing lower part 4 has fitting element receptacles 22 for this, which open to a receptacle 24, which is essentially formed by the housing lower part 4 and accommodates the heating block 8. In the illustrated embodiment on each face side of the housing lower part 4 two different types of fitting element receptacles 22*a*, 22*b* are provided (cf. also FIG. 3). Corresponding to the geometry of the fitting element receptacles 22, the heat generating elements 10 have on their face side ends fitting elements 26*a*, 26*b*, which each only fit into the appropriate corresponding fitting element receptacle 22*a* or 22*b*. Here the corresponding fitting element receptacles 22 are matched to the correspondingly provided fitting elements 26 such that the heat generating elements 10 can move a few tenths of a millimeter transverse to the longitudinal extent of the layers of the heating block 8 in the housing 2. The outer fitting elements 26*a* are formed as hammer heads and engage appropriately formed fitting element receptacles 22*a*. In the longitudinal direction of the heat generating elements 10 these are substantially shorter than the second, centrally provided fitting element receptacles 22*b*. The fitting elements 26*b* assigned to these longitudinal fitting element receptacles 22*b* are bar-shaped and less wide than the hammer-head shaped fitting elements 26*a*. Due to this special design the central heat generating elements 10 do not fit into the outer positions for heat generating elements 10 on the heating block. In a corresponding manner the outer heat generating elements cannot be arranged in the centre of the heating block, i.e. inserted into the housing 2.

Whereas the heat generating elements 10 cannot be inserted at just any random place in housing 2, the heat dissipating corrugated rib elements 12 are produced non-specifically and initially as longitudinal sections of a meander-type bent sheet metal strip and are then cut to length from this endless material. Each individual heat dissipating element 12 can be inserted at any position for a heat dissipating element within the heating block 8.

The fitting elements 26 are formed in one piece on a positional frame 28, which can be seen in FIGS. 6 and 7 and are explained in more detail with reference to these figures. The positional frame 28 consists of an insulating material and is used for positioning the PTC heating elements 30. Here, for each individual PTC heating element 30 a receptacle 32 is cut out in the positional frame 28, which circumferentially holds and configures this PTC heating element. On both sides of each of the PTC heating elements 30, which are arranged adjacent to one another on one plane, sheet metal bands 34, 36 make contact, which form electrical printed conductors for powering the PTC heating elements 30 and via which the heat produced by the PTC heating elements is passed to the heat dissipating elements 12 by means of thermal conduction. These are located directly on the sheet metal bands 34, 36.

The face side ends of the positional frames 28 are extended by a fitting element ridge 38 beyond the position of the sheet metal bands 34, 36. At the outer ends of the fitting element ridges 38 there are the respective fitting elements 26 of the positional frame 28. As illustrated by the cross-sectional view along the line VII-VII drawn in FIG. 6 (cf. FIG. 7), most of the extent of the positional frame 28 in the width direction is taken up by the respective sheet metal bands 34, 36. In the cross-sectional view at the side next to the sheet metal bands 34, 36 the positional frame has retaining ridges 40, which are provided immediately adjacent to the side edge of the sheet metal bands 34, 36 and protrude over the corresponding sheet metal bands 34, 36 on the upper side and overlap them at the outside, preferably touching the printed conductors 34, 36 and making contact to them. In the illustrated embodiment the retaining ridges 40 are formed as a single part in the course of injection moulding, initially as protrusions extending at right angles to the principal extension direction of the positional frame 28. The spacing of oppositely situated protrusions is selected such that the sheet metal band 34 or 36 just fits between these protrusions.

The one-part component manufactured in this way by means of injection moulding is then fitted with the main parts of the heat generating element 10, i.e. the PTC heating elements 30 are inserted into the corresponding receptacle 32 and surrounded on both sides by the sheet metal bands 34, 36. Thereafter the recesses are plastically deformed inwards, comprehensively forming the printed conductors 34, 36. Here, normally hot forming is applied in which the material forming the retaining ridges 40 is heated locally in the region of the sheet metal bands 34, 36 and is thus softened. The means employed in each case can for example locally heat the positional frame 28 by means of hot air or thermal conduction. In the case of heating using thermal conduction the means causing the heating is preferably formed by a tool which simultaneously carries out the shaping of the retaining ridges 40.

The retaining ridges 40 are not formed continuously in the longitudinal direction of the heat generating element 10, but rather are provided in sections 40.1 to 40.5. These sections 40.1 to 40.5 leave a passage 41 free between them which is formed such that in each case a strut 20 fits between the sections 40.1; 40.2; 40.3; 40.4 or 40.5 in the width direction. The section formed by the passage 41 protrudes with respect to the outer surface of the retaining ridges 40 in each case so far inwards that at least half the thickness of the struts 20 fits between the retaining ridges 40 and is accommodated there.

However, a positive locking engagement between the struts 20 and the positional frame 28 is missing in a direction transverse to the layers of the heating block 8 so that movement transverse to the layers of the heating block 8 is provided between the struts 20 of the housing parts 4, 6, which can also be designated as the first strut and the retaining ridges 40 which can be designated as the second strut 43.

The heat generating element 10 is formed as a preassembled component and can thus be handled during assembly without the risk that the printed conductors 34, 36 or even the PTC heating elements 30 inserted in the positional frame 28 will be lost. It must however be pointed out that normally the retaining ridges only fix the sheet metal bands 34, 36 in the positional frame, but do not contact them with contact pressure against the PTC heating elements 30, which is sufficient to reliably power the PTC heating elements 30 in operation. With the embodiment discussed within the scope of the present invention this is in any case carried out by a spring element which is explained in more detail with reference to FIGS. 8 to 10.

First however, some features will be dealt with which ensure that parts of the heating block 8 cannot be installed just at any random place within the housing 2.

Figure 3:
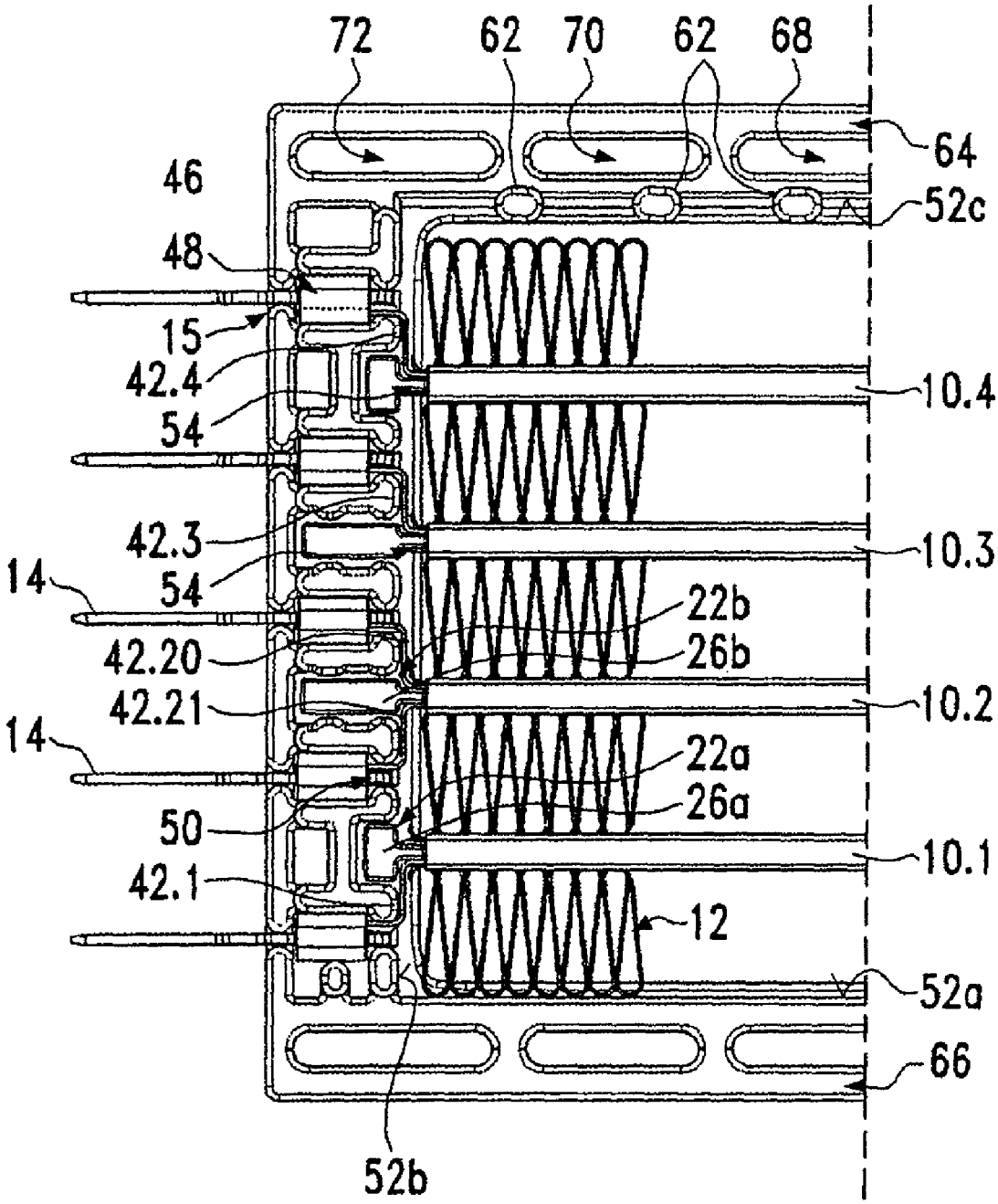
FIG. 3 an enlarged detail from the illustration according to FIG. 2.
Figure 6:
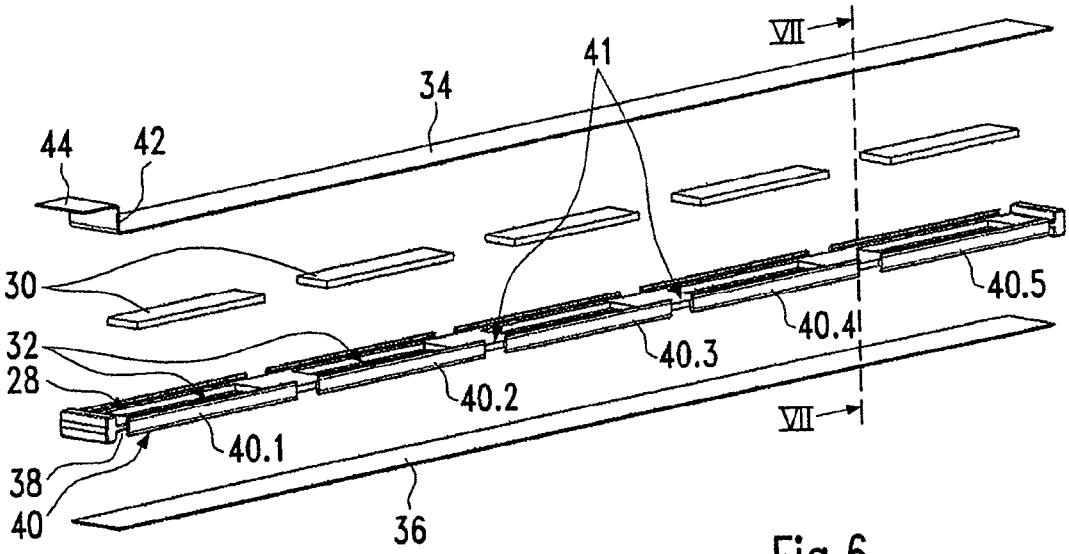
FIG. 6 a perspective exploded view of a heat generating element of the electrical heating device according to FIG. 1.
Figure 7:
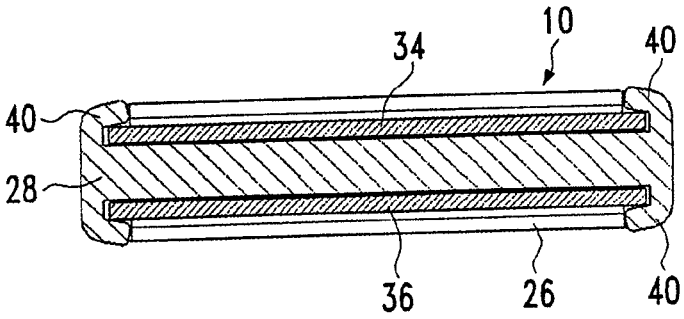
FIG. 7 a sectional illustration along the line VII-VII according to the illustration in FIG. 6 of an assembled heat generating element.

As can be seen, in particular from FIGS. 3 and 6, a sheet metal band, i.e. the sheet metal band 34 illustrated in FIG. 6, is bent out of the plane of the heat generating element 10. Consequently, an offset 42 is produced between the plane in which the sheet metal band 34 contacts the PTC heating elements 30 and a free end 44 which extends parallel to the first mentioned principal section of the sheet metal band 34 due to being again bent, but in the opposite direction. As can be seen from FIG. 3, this free end 44 is mechanically and electrically connected by a crimping element 46 to the assigned contact lug 14.

The upper heat dissipating elements in FIG. 3 designated with reference numerals 10.3 and 10.4 have an offset 42.3 and 42.4 projecting from the upper sheet metal band 34 upwards. The lower heat generating element 10.1 has an offset 42.1 projecting downwards. The sheet metal bands 34, 36 of the heat generating element 10 designated with reference numeral 10.2 are bent on both sides to form an offset 42.20 or 42.21 and each is provided with a contact lug 14. Due to these differences there is the possibility of preventing interchanging the positions of the heat generating elements 10.3 and 10.2 within the housing 2. In this case due to the design of the contact lug receptacles 48, the embodiment permits interchanging of the two central heat generating elements 10.2 and

10.3. An appropriate interchange ability is also given for both outer heat generating elements 10.1 and 10.4.

The slots 15 previously mentioned with reference to FIG. 1 extend from the outer side of the housing 2 and run into the lug receptacles 48 widened in each case with respect to the slots 15. Behind this contact lug receptacle 48 a constricted slot 50 is in turn formed, which can accommodate a sheet metal piece shaped by punching and forming the contact lug 14 as well as the free end 44 of the assigned sheet metal band 34.

The housing lower part 4 can be formed in an economically manufactured injection mould, because all the surfaces significant for the housing 4 extend parallel or at right angles to the frame opening 18 of the housing lower part 4.

Thus, the housing lower part 4 has firstly frame surfaces 52*a-d* which essentially run at right angles to one another, which circumferentially surround the heating block 8 and run at right angles to the plane which contains the frame opening 18. On the face side, on which the contact lugs 14 are brought out of the housing lower part 4, the corresponding frame surface 52*b* opens outwards over four fitting element receptacles 54, the principal walls of which also extend at right angles to the plane which contains the frame opening 18. Those functional surfaces of the housing lower part 4, which essentially form the contact lug receptacles 48 as well as the slots 15 or 50 leading to them as well as those walls which delimit the fitting element receptacle 22 and are illustrated in FIG. 3, have an appropriate extent. The above described receptacles 15, 22, 50 and 54 are delimited on the side of the housing lower part 4 by a bottom, which runs parallel to the plane which contains the frame opening 18 of the housing lower part 4. This receptacle bottom is identified in FIG. 4 with the reference numeral 56. This bottom 56 also forms the inner surface of the struts 22 as well as on one hand limit stops 58, 60 at the edge for the spring element still to be explained as well as on the other hand the outer heat dissipating element 12 located on the oppositely situated longitudinal side. These limit stops 58 or 60 are in turn parallel to the plane which also contains the frame opening 18.

The inner surface of the housing lower part 4, which is formed on the face side of the face side ends of the walls which form the fitting element receptacles 22 or the contact lug receptacles 48, runs parallel to this plane. On a longitudinal side this upper edge is formed by spacers 62, which project over the frame surface 52*c* to the receptacle 24 and its function will be dealt with in the following description of the spring element. Below this upper plane of the inner surface of the housing lower part 4 there are the inner surfaces 63 of the two longitudinal spars 64, 66 of the housing lower part 4, which however project so far beyond the limit stops 58, 60 at the edge that the heating block 8 is almost completely circumferentially held, i.e. with more than 70% of its height extent, in the housing lower part 4. The longitudinal spars 64, 66 are interspersed by pin guides 68, 70, 72, which extend at right angles to the plane which contains the frame opening 18. The pin guides 68, 70, 72 intersperse in sections essentially the whole longitudinal extent of the longitudinal spars 44, 66.

In the centre of the respective longitudinal spars 64, 66 there is a pin guide 70, which is formed with a relatively short length and opens into a window 74 located on the outside of the housing lower part 4. Adjacent to this central pin guide 70, pin guides 68 are provided which extend in each case over about ⅓ of the length of the longitudinal spars 64, 66. On the outer end of these pin guides 68 there are in turn pin guides 70 with assigned windows 74, as described above. On the face side ends of the longitudinal spars 64, 66 again relatively small pin guides 72 are formed which extend from the inner surface of the longitudinal spars 64, 66 to the outer surface of the housing lower part which also contains the frame opening 18.

The functional surfaces forming or delimiting the pin guides 68, 70, 72 all extend at right angles to the plane which contains the frame opening 18. Only the face side edges of the corresponding openings 68 to 72 are slightly bevelled or rounded off in order to facilitate the introduction of corresponding guide pins 76 to 80 of the housing upper part 6. For easier joining of the housing lower part 4 and housing upper part 6, furthermore the free ends of the walls are also bevelled or rounded off which delimit the spacers 62 as well as the receptacles 22*b*, 15, 50, 48 at the ends and form the upper ends of the spacers 62.

Figure 5:
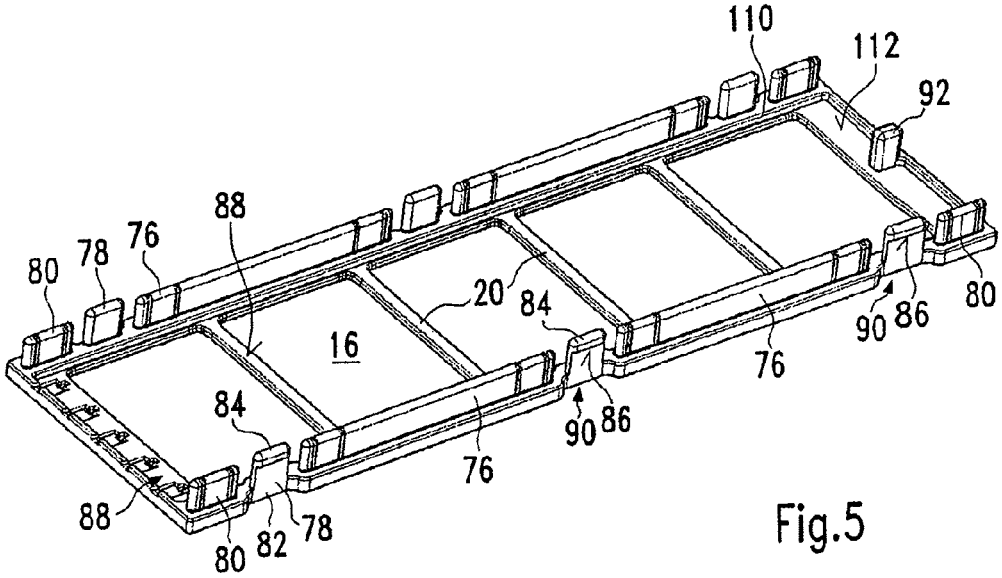
FIG. 5 a perspective side view of the housing upper part of the electrical heating device according to FIG. 1.

The housing upper part 6 shown in perspective illustration in FIG. 5 also has exclusively functional or delimiting surfaces aligned orthogonal or parallel to the corresponding housing opening 16. As functional surfaces in particular the guide areas of the previously mentioned guide pins 76, 78, 80 are provided which can be introduced into the corresponding pin guides 68, 70, 72. The guide pins 78 are moulded as notched pins and form latching ridges 82, over which on the upper side a thickened head of the notched pin 78 protrudes, which form a latching surface 86 which extends parallel to the plane which also contains the frame opening 16. The latching ridges 82 extend from the upper side of a cover 88, which is formed essentially as a flat component and produces the frame opening 16 and furthermore contains the outer surface of the struts 22. The cover 88 is formed frame-shaped as a cover for the housing lower part 4. Accordingly, the guide pins 76 to 80 extend from the inner side of the cover 88 at right angles. A recess 90 is provided for the latching ridges 82. In the region of the recess 90 the edge surface of the cover 88 is drawn inwards so that the flat, even side surface of the latching ridge 82 extends parallel to the guide surfaces of the guide pins 76 or 80, but is located inward to the respective outer guide surface of these guide pins 76, 80. The inner surfaces of the corresponding guide pins 78 to 80 facing the heating block 8 nevertheless lie in one plane.

On one face side of the housing upper part 6, on the inner wall of the cover 88, five recesses are formed corresponding to the five contact lug receptacles 48 which form part of the slots 15 and also comprise an upper margin region of the contact lugs 14 after the assembly of the heating block in the closed housing. On the oppositely situated face side a further guide pin 92 is provided, which interacts with a corresponding further guide receptacle cut out on the housing lower part 4, but does not fit into the fitting element receptacles 22 or the contact lug receptacles 48, so that it is ensured that the housing upper part 6 is placed on the housing lower part 4 and joined to it in a predetermined and unambiguous manner. Also the walls enclosing the further pin guide 94 and forming the guide pin 92 extend at right angles to the plane located on the frame opening 16 or 18.

Figure 8:
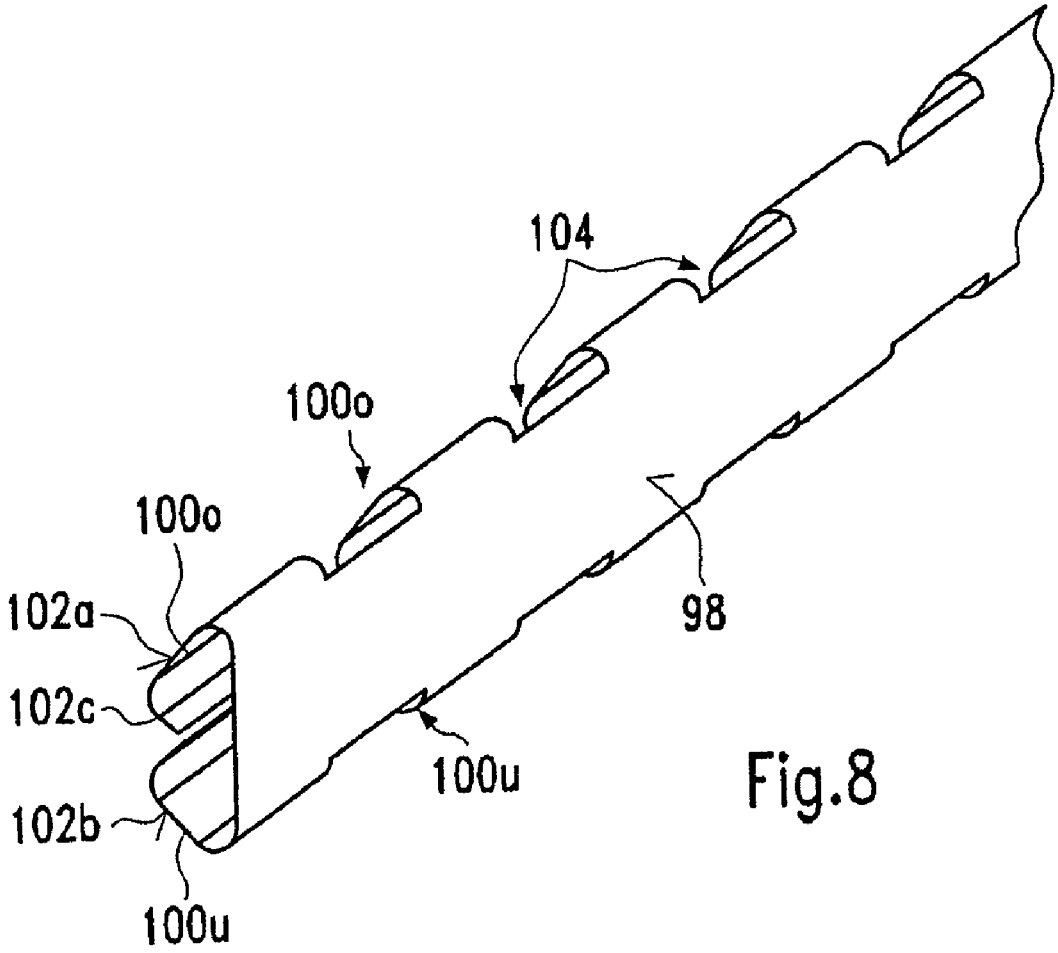
FIG. 8 a perspective side view of a spring element for prestressing the heating block of the embodiment illustrated in FIGS. 1 to 7.
Figure 9:
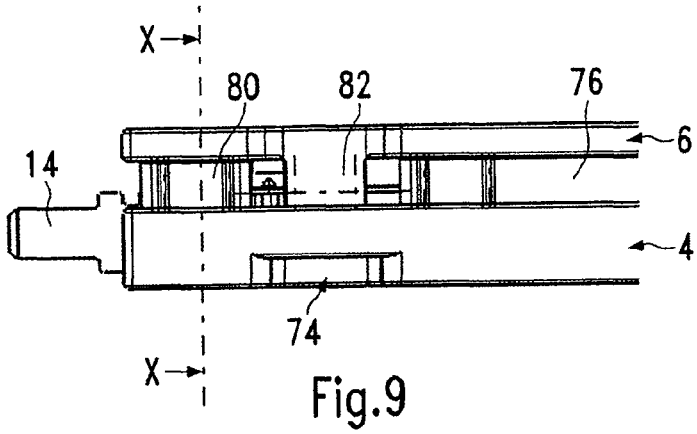
FIG. 9 a side view of an end of the example according to FIG. 1 before joining the housing parts.

FIG. 8 illustrates a perspective side view of a spring element 96, which contacts the heating block 8 at the edge and is located in its installation position at the level of the heating block 8. The front side of the spring element 96 in FIG. 8 forms a flat locating face 98 to which the adjacent, the uppermost in FIG. 3, heat dissipating element contacts with its vanes. Put more accurately, the face side bent ends of more meandering vanes of the corrugated rib band 12 contact this locating face 98. The locating face 98 is formed by an initially flat sheet metal band, on which transversely protruding spring limbs 100 have been formed by punching on both sides, which lie initially within the plane of the locating face 98 and after punching have been brought into the shape recognisable in FIGS. 8, 10, 11 and 12 by bending. Two spring limbs 1000, 100*u* lie overlapping in the width direction, i.e. transverse to the longitudinal extent of the flat locating face 98 and thus in the insertion direction of the spring element 96 during assembly. Each individual spring limb 100*o*, 100*u* forms the sloping sliding surface 102*a*, 102*b*, 102*c*, which in each case includes an angle of between 35 and 55°, preferably about 45°, between it and the flat locating face. Between the pairs of spring limbs 100 provided one behind the other in the longitudinal direction of the spring element 96 there are flat segments 104 in which the spring element 96 is formed as a rectangular flat sheet metal band.

Figure 4:
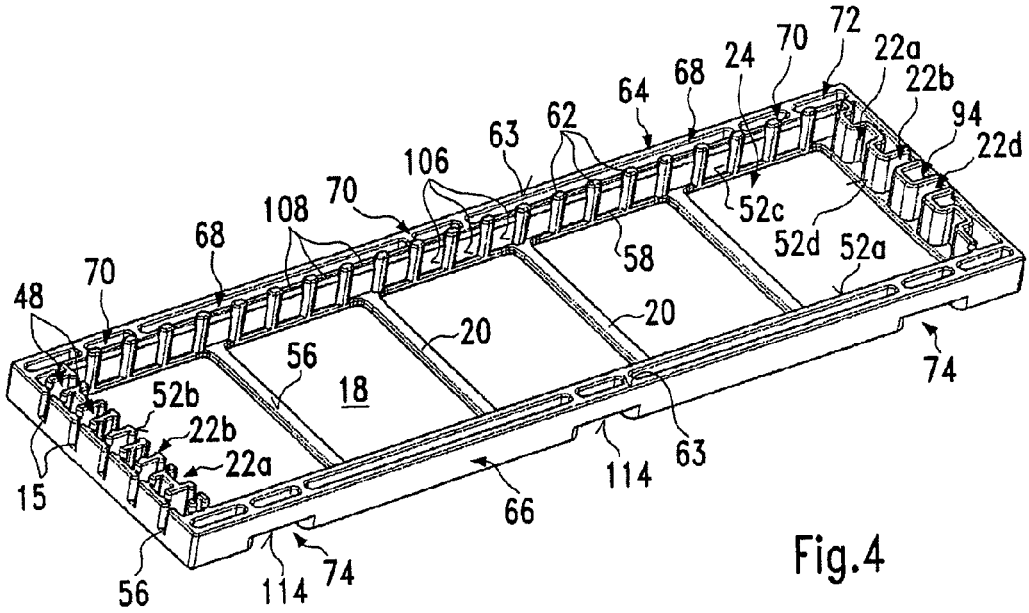
FIG. 4 a perspective side view of the embodiment illustrated in FIGS. 1 to 3.

The spring element 96 illustrated in FIG. 8 has pairs of spring limbs 1000, 100*u* corresponding to the number of intervening spaces between the individual spacers 62 on the longitudinal spar 64 (cf. FIG. 4). Each pair of spring limbs 1000, 100*u* lies in the installation position of the spring element 96 between these spacers 62. The flat segment 104 spans the width of the spacers 62 and joins together adjacent pairs of spring limbs 1000, 100*u*. The correspondingly manufactured spring can thus be introduced as a one-part component into the housing 2, in particular into the housing lower part 4, which simplifies the manufacture of the electrical heating device. The wall sections of the frame surface 42*c* provided between adjacent spacers 62 accordingly form a supporting surface 106 for the respective pairs of spring limbs 100. Due to the matching of the spring element 100, in particular of the embodiment of the flat segments 104 between the pairs of overlapping spring limbs 100, it is not possible to introduce the spring element 96 into the housing lower part 4 in the incorrect alignment. The spring element 96 can then only be pushed into its installation position, in which the spring element is accommodated at the level of the heating block 8 in the housing 2 when the flat locating face 98 is aligned to the heating block. Furthermore, the heating block is held by the spacers 62 at a distance to the supporting surfaces 106 so that the spring element 96 can contact these surfaces at any time on introduction into the housing lower part 4 and without hindrance by the heating block 8.

With a continuing insertion movement of the spring element 96 in the direction of the heating block 8, i.e. with continuing insertion into the heating block, the spring element 96 is then forced in the direction of the heating block 8 due to the spring force from the lower spring limb 100*u*, so that the layers 10, 12 of the heating block are compressed. The flat locating face 98 with the adjacent heat dissipating element 12 already has a covering such that with a continuing insertion movement the spring element 96 is sufficiently guided in the insertion direction between the heating block 8 and the housing lower part 4. Finally, with continued insertion the lower spring limb 100*u* is elastically compressed. The counter force on the housing side is here formed by an upper edge 108, which is formed between the supporting surface 106 and the inner surface of the longitudinal spar 64 by the meeting point of the two surfaces. This edge 108 initially forces the lower spring limb 100*u* inwards on the introduction of the spring element 96. With a continued introduction movement the upper spring limb 1000 is finally forced inwards by the interaction of the free end of the corresponding spring limb 1000 which is bevelled inwards and bent.

Figure 10:
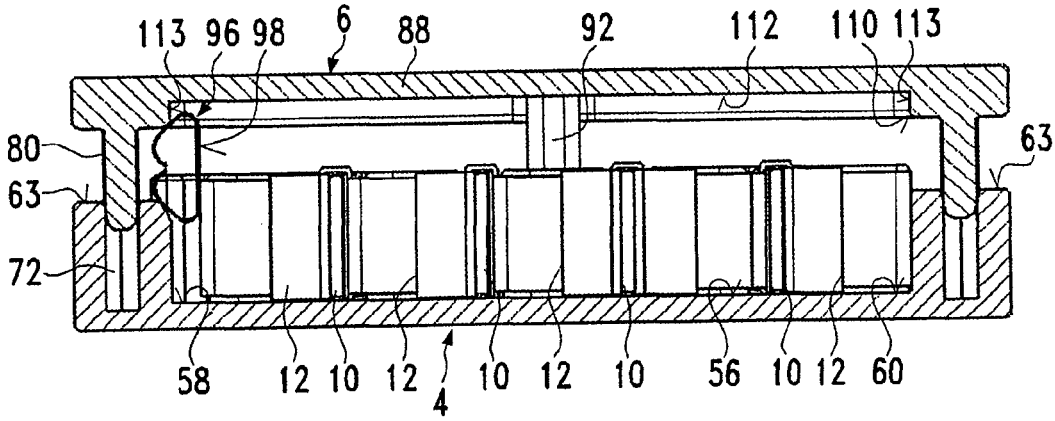
FIG. 10 a sectional view along the line X-X according to the illustration in FIG. 9.
Figure 11:
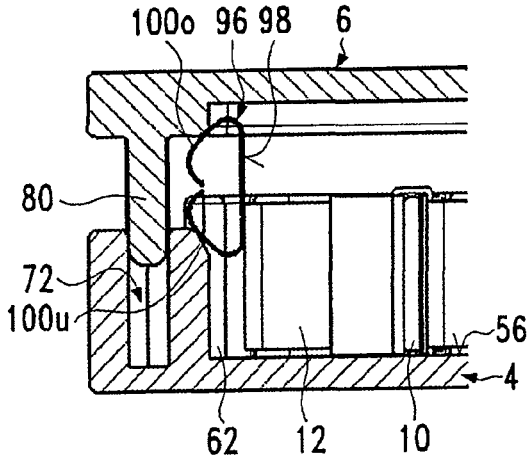
FIG. 11 an enlarged detail view of the detail A in FIG. 10.

As can be seen from FIGS. 10, 11 and 12, the housing 2 has a further housing element which interacts with the spring element 96. This further housing element is formed by an edge 110 of the housing upper part 6, which is formed between the inner surface of the cover 88 and a bottom 112 of the housing upper part 6, and in fact by the joining edge of an outer edge 113 delimiting the bottom 112 of the housing upper part with the inner surface of the cover 88. The height offset between this bottom 112 and the inner surface of the cover 88 takes into account that the heating block 8 protrudes over the surface 63 formed by the longitudinal spars 64, 66, and in fact approximately with the same length as the spacers 62 protrude over the inner surface 63 of the longitudinal spars 64, 66. The edge 110 contacts a sloping sliding surface 102*a* of the spring element 96 which is formed by the upper spring limb 100*o*. As emerges from FIGS. 10 and 12*a*, the upper end of the spring element 96 is in a state essentially free of contact pressure with spacing to the bottom 112 of the housing upper part 6.

For the description of the assembly reference is made in the following to FIGS. 12*a* to 12*e*. First the individual layers 10, 12 are introduced into the housing lower part 4. Then the spring element 96 is manually inserted part way into the housing lower part, in each case so far until the layers of the heating block 8 are located against one another and the spring element 96 is placed sufficiently deeply between the heating block 6 and the frame surface 52*c*.

This initial introductory movement, through which the spring element 96 essentially introduces no spring pressure into the heating block 8, guides the spring element 96 over the face side surfaces of the spacers 62 facing the heating block 8, which interact with the flat segments 104 of the spring element 96. Due to the contacting of the spring element 96 and spacers 62, the spring element 96 is aligned with its flat locating face 98 parallel to the layers 4, 6 of the heating block. After this first assembly step the spring element 96 protrudes over the plane taken up by the heating block 8 by a longitudinal section which is identified with L in FIG. 12*a*. Then the housing upper part 6 is placed on the housing lower part 4. The guide pins 76, 78, 80, 92 here engage in the corresponding pin guides 68, 70, 72, 94. In doing this, the spring element 96 remains initially essentially free of stress. In this state sufficient coverage between the guide pins and the corresponding recesses can already be achieved so that both housing parts 4, 6 can only be moved in a linear direction relative to one another. Then follows the joining of the housing parts 4, 6 with the application of the spring force.

Figure 12A:
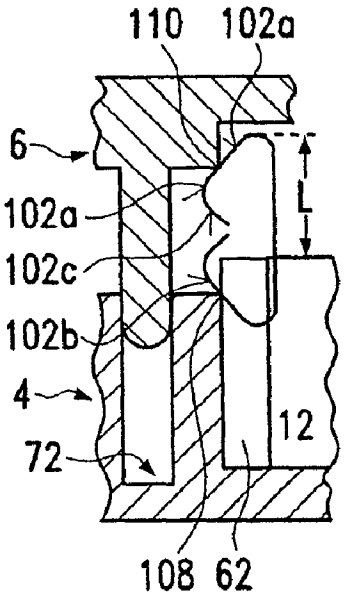
FIGS. 12*a* to 12*e* enlarged detail views similar to the view according to FIG. 11 in various states during joining the housing parts.
Figure 12B:
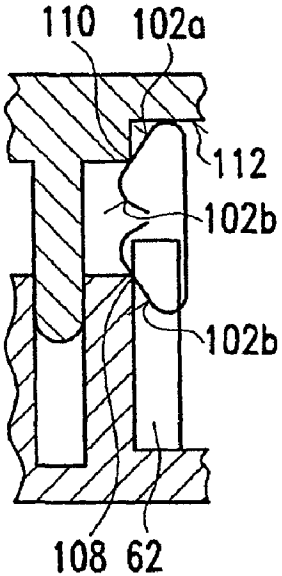
Figure 12C:
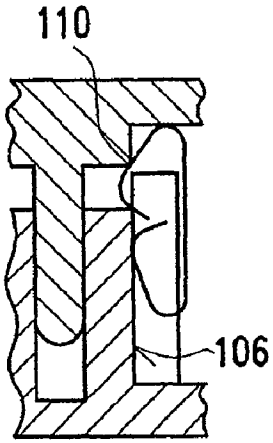
Figure 12D:
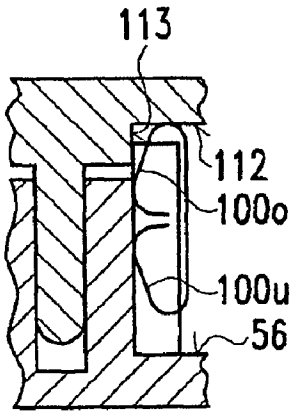
Figure 12E:
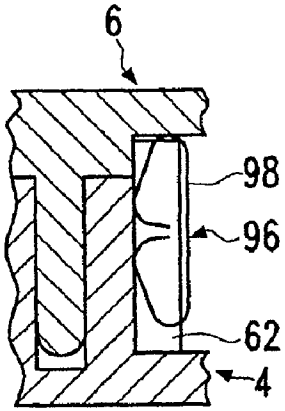

First, the spring limbs 100*o*, 100*u* are slightly compressed until the bottom 112 of the housing upper part 6 meets the upper end of the spring element 96 (cf. FIG. 12*b*). The two edges 108 and 100 have here already slid a certain way along the sloping sliding surfaces 102*a* and 102*b*. The upper spring limb 1000 is in this way already bent elastically so far inwards that with increasing insertion movement the free end of the limb 1000 bent inwards at the centre of the spring element 96, which forms a further sloping sliding surface 102*c* can reliably pass the edge 108. Thereafter, a continuing joining movement between the two housing parts 4, 6 also leads to the spring element 96 being carried along. Here, initially the edge 108 produces a further elastic stressing of the lower spring limb 100*u*. This lower spring limb 100*u* is finally completely accommodated between the supporting surface 106 and the heating block 8 (FIG. 12*c*). With increasing insertion of the spring element 96 into the housing lower part 4 the upper spring limb 1000 is finally also elastically deformed by the interaction of the edge 108 with this upper spring limb 1000 in the direction of the heating block 8 and accordingly produces a spring force. This elastic spring force is mainly produced in that the edge 108 slides down the further sloping sliding surface 102*c* and forces the upper spring limb 100*o* in the direction of the heating block 8 (intermediate step between FIG. 12*c* and FIG. 12*d*). The spring element 96 has reached its final position when the two housing parts 4, 6 contact one another with their respective surfaces aligned to one another. The spring element 96 is stressed and held in this installation position due to the spring force between the heating block 8 and the frame surface 52*c*. If the spring element 96 is pushed from outside by an unintentional force, the limit stop 58 or the bottom 112 of the housing upper part 6 in each case prevents the spring element 96 being forced out of the housing 2.

Shortly before the two housing parts 4, 6 contact one another, heads 84, which are guided in the guide channels under slight elastic bending of the latching ridges 82 in the pin guides 70, are forced outwards, so that their latching surface 86 contacts a latching counter surface 114 or it protrudes beyond it with slight play, so that both housing parts 4, 6 are fixed together captively.

As the above description explains, during the manufacture of the electrical heating device according to the discussed embodiment, on closing the housing by joining the housing lower part and housing upper part, the spring element is brought into its installation position in which the spring element is located at the level of the heating block, i.e. it is arranged in the plane which is also taken up by the heating block. Furthermore, the spring element is only put under spring pressure on introduction and only then when the two housing parts 4, 6 are guided relative to one another by the positive locking engagement of the guide pins 76 to 80 in the corresponding pin guides 68, 70, 72. The constructive development accordingly offers the possibility of introducing the components of the heating block into the receptacle 24 formed by the housing 2 without tension being applied. It is only thereafter that spring stressing follows and in fact this occurs on making contact and in housing parts 4, 6, limited with respect to one another in position. If thereafter, due to the spring pressure produced, on joining the housing parts 4, 6, displacement of the elements of the heating block 8 or even forcing out of the elements of the heating block 8 from the receptacle 24 occurs, these parts are held by the parts of the housing parts 4, 6 enclosing the heating block in the housing 2 and forced back into the desired position on joining the housing parts 4, 6.

With regard to the constructive development the present invention is not restricted to the embodiment described. Thus, a spring element can for example be provided which has a spring limb which in the installation position is initially essentially free of stress. This spring element is introduced without stress with the heating block into the receptacle 24. The spring element has a spring limb and the spring limb forms a sliding surface sloping obliquely outwards and downwards in the direction onto the limit stop 58, and in fact for a pin, which interacts with the spring element and sets the corresponding spring limb during the joining of the housing upper part and housing lower part under spring pressure such that the spring element overall contacts the heating block 8 under spring pressure. With this embodiment the spring element is initially accommodated without stress together with the heating block in the housing lower part and however remains stationary relative to the joining direction on production of the spring pressure. The spring element is just pushed slightly in the plane of the heating block and contacts the heating block. Furthermore, the spring limb or limbs are pivoted to produce the elastic stress. The special development of the heat generating elements 10 facilitates a more simple assembly, because the grid arrangement formed by the first and second struts 20, 43 is not a complete part of the housing, but rather the second struts with the positional frames 28 are formed and thus are reliably located where the PTC heating elements 30 come to rest within the heating block 8. Compared to the prior state of the art in which the grid arrangement is solely formed by the housing parts, housing parts can be accordingly manufactured which are relatively simply formed. Furthermore, higher tolerances can be permitted, because no one-part struts joined to the housing exist which extend parallel to the layers of the heating block 8 and must be provided exactly at the position of the heat generating elements 10. Through the dimensioning of the struts 20 and the passage 41 and in particular the insertion of the struts 20 between two sections of the retaining ridges 40 there is still the possibility of supporting the first and second struts 20, 43 with positive locking with respect to one another and thus of stiffening the housing overall.

Since the heat dissipating element 12 is prepared as a preassembled unit and furthermore it is ensured by the fitting elements 26 and the associated receptacle 22 that the heat generating elements 12 can only be installed at certain places within the housing 2, the production of the electrical heating device, in particular the assembly of the individual parts can also be carried out by less skilled personnel.

The definitive arrangement of the embodiment gives an unambiguous assignment of different components of the electrical heating device. If this unambiguous assignment is not maintained, the components of the electrical heating device cannot be assembled.

The invention claimed is:

1. An electric heater, comprising:

a housing defining opposite frame openings;

a planar heating block that is held in the housing and that includes parallel layers of heat-emitting and heat-generating elements, and a grid arrangement covering the respective frame openings and reinforcing the housing, wherein the grid arrangement comprises first struts and second struts that cross one another, wherein the first struts are part of the housing and extend at right angles with respect to the parallel layers and the second struts are part of the heating block and extend in parallel with respect to the parallel layers and the second struts extend in sections between the first struts so that the first struts are each fixed between two sections of the second struts in a form-closed manner.

2. The electric heater according to claim 1, wherein the second struts are arranged in the longitudinal direction of the first struts so as that the first and second struts are movable with respect to each other.

3. The electric heater according to preceding claim 1, wherein the second struts are defined by a positional frame made of an insulating material, wherein the positional frame defines receptacles provided side by side with each other, and wherein each receptacle is configured to hold at least one PTC heating element.

4. The electric heater according to claim 3, wherein conductor paths rest on both sides of the PTC heating elements, and wherein sections of the second struts externally overlap the conductor paths.

5. The electric heater according to claim 4, wherein conductor paths abut on at least one PTC heating element via a spring device holding the heating block in the housing under a spring pretension.

6. The electric heater according to claim 1, wherein an upper and lower side of the heat-generating elements, between sections of the second struts, are defined by conductor paths.

7. The electric heater according to claim 2, wherein the first struts are movable relative to the heating block in a direction transverse to the layers.

8. The electric heater according to claim 1, wherein the grid arrangement consists of the first struts and the second struts.

* * * * *